US007615941B2

(12) United States Patent
Blumel

(10) Patent No.: US 7,615,941 B2
(45) Date of Patent: Nov. 10, 2009

(54) APPARATUS AND METHOD FOR MAXIMIZING THE LONGEVITY OF ARC TUBE BULBS DURING PULSING OPERATION

(76) Inventor: Daniel M. Blumel, 1148 5th St., Ogden, UT (US) 84404

( * ) Notice: Subject to any disclaimer, the term of this patent is extended or adjusted under 35 U.S.C. 154(b) by 0 days.

(21) Appl. No.: 11/207,138

(22) Filed: Aug. 17, 2005

(65) Prior Publication Data

US 2007/0040515 A1 Feb. 22, 2007

(51) Int. Cl.
*G05F 1/00* (2006.01)

(52) U.S. Cl. ..... 315/309; 315/291; 315/224; 315/247; 315/209 R

(58) Field of Classification Search ..... 315/247, 315/246, 224, 225, 291, 307, 209 R, 309
See application file for complete search history.

(56) References Cited

U.S. PATENT DOCUMENTS

| | | | | |
|---|---|---|---|---|
| 3,501,728 | A | 3/1970 | Barriball | |
| 3,648,207 | A | 3/1972 | Caltagirone | |
| 4,066,930 | A | 1/1978 | Summa | |
| 5,175,525 | A | 12/1992 | Smith | |
| 5,559,682 | A | 9/1996 | Kanouda et al. | |
| 5,684,445 | A | 11/1997 | Kobayashi et al. | |
| 6,007,015 | A | 12/1999 | Kinutani et al. | |
| 6,114,932 | A | 9/2000 | Wester et al. | |
| 6,211,767 | B1 | 4/2001 | Jitaru | |
| 6,333,607 | B1 * | 12/2001 | Yamamoto et al. | 315/307 |
| 6,486,614 | B1 | 11/2002 | Nakano | |
| 6,548,948 | B1 | 4/2003 | Muessli | |
| 6,812,623 | B2 | 11/2004 | Takeda et al. | |
| 6,879,235 | B2 | 4/2005 | Ichikawa | |
| 7,023,142 | B2 * | 4/2006 | Chou et al. | 315/209 PZ |
| 2001/0020825 | A1 | 9/2001 | Miyata et al. | |
| 2004/0108929 | A1 | 6/2004 | Ichikawa et al. | |
| 2005/0110428 | A1 * | 5/2005 | Crandall et al. | 315/224 |
| 2006/0017400 | A1 * | 1/2006 | Tehori et al. | 315/274 |

* cited by examiner

*Primary Examiner*—Tuyet Vo
(74) *Attorney, Agent, or Firm*—Todd E. Zenger; Dax D. Anderson; Kirton & McConkie

(57) ABSTRACT

Heating or powering a filament less light bulb, and preferably a High Intensity Discharge light sufficiently close to steady state temperature and then pulsing the current, thereby improving and or maximizing the life of the bulb, reducing the power draw during pulsing mode, and obtaining maximum brightness during the entire operation in pulsing mode.

12 Claims, 2 Drawing Sheets

APPARATUS AND METHOD FOR MAXIMIZING THE LONGEVITY OF ARC TUBE BULBS DURING PULSING OPERATION

BACKGROUND

1. Field of the Invention

The present invention relates to an apparatus and method for maximizing or extending the longevity of arc tube bulbs. Specifically, the present invention relates to a method for preheating a high-intensity discharge light bulb to extend the life of the bulb, to reduce the power draw during pulsing operation, as well as to get full light intensity when pulsing begins.

2. Background of the Invention and Related Art

Arc tubes, like those found in high-intensity discharge lamps, have a variety of applications including emergency vehicles, automobile headlights, outer-space applications, and airplane landing/taxi lights. High-intensity discharge lamps or HIDs are particularly adapted to these applications because of the high luminescence that they produce. This brightness can be helpful in both alerting others of the user's presence, as well as illuminating a desired location.

The present invention is particularly useful as a means to alert others to the presence of certain activities or vehicles. Many applications benefit from the HID bulbs being able to pulse on and off or from an un-energized to an energized state and cycling the illumination. Lighting a cold arc tube in an HID lamp consumes enormous amounts of energy and requires high voltage. This high voltage requirement and power consumption continue for an extended period of time when operating in pulse mode because the HID lamp, when it is initiated in pulse mode, spends as much time off as it does on, permitting repeated cooling of the tube. Thus, the time required to reach an efficient, steady state operating temperature is significantly increased. The repeated ramping up and dropping off voltage to light the arc tube, i.e., in a cooler than operating steady state, accelerates the wear and deterioration of the electrodes, thus slowly increasing the distance or gap between the electrodes. This problem of increasing distance between the electrodes further increases the amount of voltage required to spark the arc tube and generate light. Thus, it can be seen that operating an HID in a pulsing mode, as taught by the prior art, reduces the longevity of the bulb or electrodes and ballast circuitry, thus requiring frequent replacement of the bulbs and/or ballast circuitry.

Frequent striking the arc tube in a cooler state also places an increased amount of stress on the ballast or circuitry used to strike the bulb arc. As discussed above, operating a cold or warm arc tube requires substantially more wattage than operating a hot bulb or a bulb at operating steady state. Thus, when a cold or warm bulb is initiated in a pulsing mode directly, it places stress on circuitry and requires sustained high-power draws until the bulb reaches a steady state operating temperature.

Finally, when a bulb goes from a cold temperature or off mode directly to a pulsing mode, the full brightness of the bulb is not realized because the metal halide salts in the arc tube are not sufficiently vaporized to a plasma state. It is only after an extended duration of operation in pulsing mode that the lights can attain full brightness, due to the slowed warm up phase.

SUMMARY

These shortcomings of the prior art are primarily remedied by preheating the arc tube of an HID bulb through lighting the bulb and allowing it to be lit for a predetermined time or until the bulb reaches a predetermined power level. In this way, the present invention increases or extends the life of the bulb, reduces the power draw during pulsing operation, and creates a maximum light output from the bulb during pulsing.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE PREFERRED EMBODIMENTS

It will be readily understood that the components of the present invention, as generally described and illustrated in the figure herein, could be arranged and designed in a wide variety of different configurations. Thus, the following more detailed description of the embodiments of the system and method of the present invention is not intended to limit the scope of the invention, as claimed, but is merely representative of the presently preferred embodiments of the invention.

The term power source, as defined herein, can be an alternating current or a direct current power source.

The term current manipulator, as used herein, can be electrical, or mechanical and can be electronically or manually adjusted or set to adjust upon sensing preconditioned limits.

The term heating, as used herein, includes powering.

The term maximizing means maximizing and/or improving a feature of the present invention.

An arc tube 30 as defined herein is any burner not requiring a filament to produce light, but that utilizes excited gasses in a plasma state to emit light radiation. Arc tube 30 may be integrated into a bulb assembly including an igniter, or may be the arc tube alone. In either case, the present invention contemplates an arc tube coupled to an igniter.

Many prior art and currently available HIDs are known. For example, HID bulbs are manufactured and/or sold by Philips, GE and Sylvania (Osram).

Figure 1:
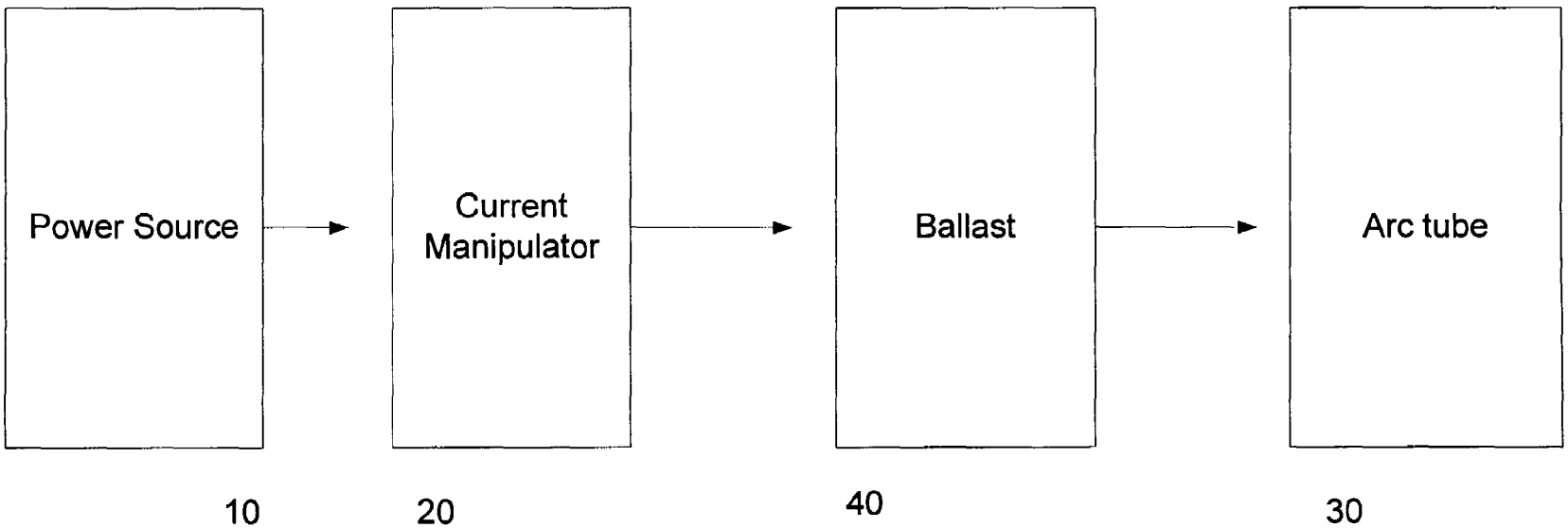
FIG. 1 illustrates a schematic of an exemplary embodiment of the present invention.

Referring now to FIG. 1, there is a power source 10 coupled to a current manipulator 20. The power source as taught herein is coupled by electrically conductive wires to the manipulator 20. The current manipulator 20 is a circuit which delivers current to flow in a constant mode or in a pulsing mode. The current manipulator 20 may further comprise a timing switch or other electronic components commonly known in the art, which will cause the electrical current to pulse from an on mode to an off mode at a frequency of a fraction of a Hertz to several Hertz, as desired.

The current manipulator 20 is further connected to an HID ballast 40. The current manipulator 20 delivers power to a ballast 40 for igniting the arc tube 30 either in the on mode or the pulsing mode.

Figure 2:
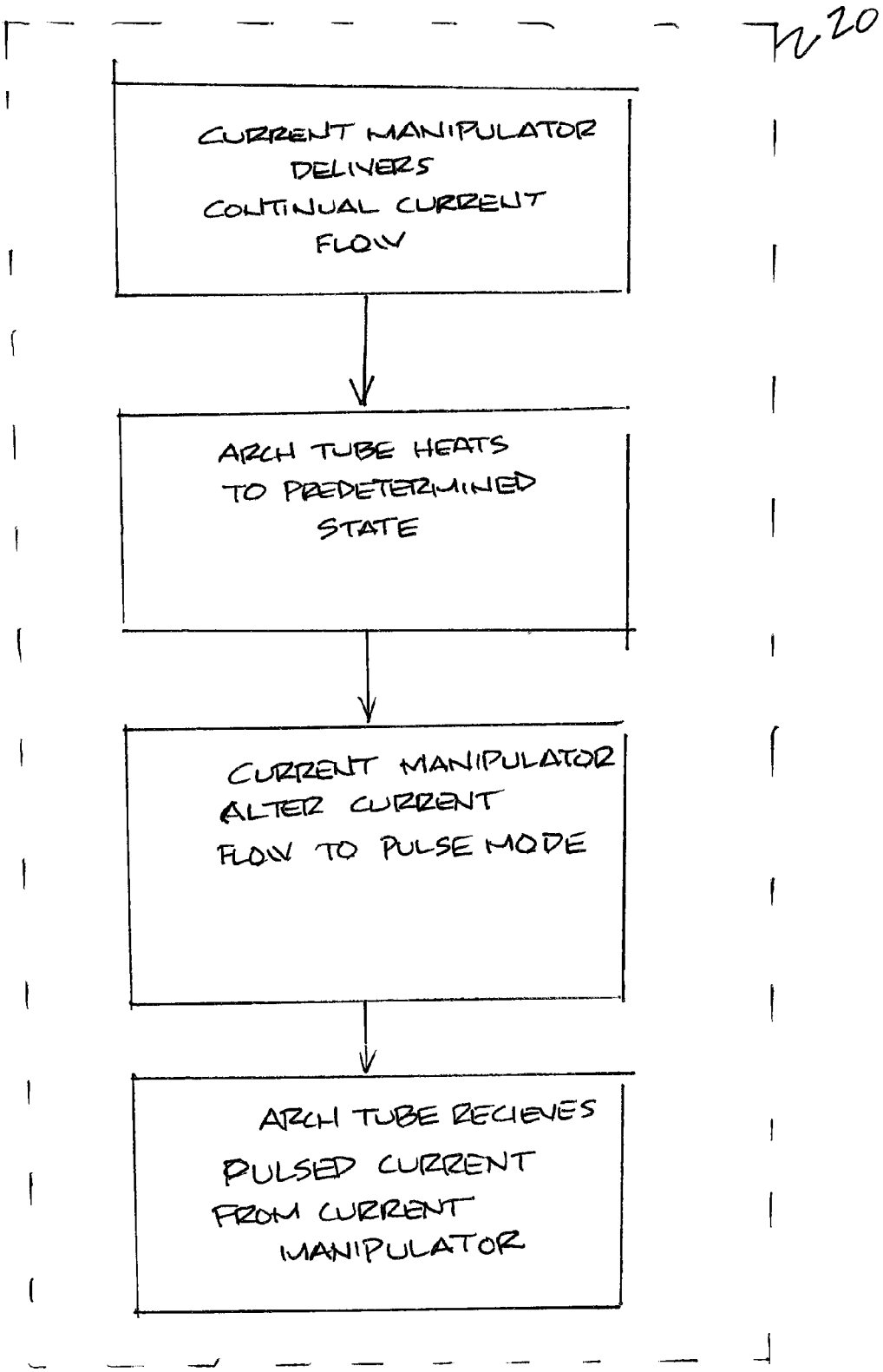
FIG. 2 depicts one embodiment of the function of the current manipulator.

As taught by the present invention, the current manipulator 20 provides a suitable current and voltage to the ballast 40 which provides power to the arc tube 30 until the arc tube 30 reaches a temperature sufficiently close to steady state operating temperature. Depending upon the embodiment, it may take up to a few minutes. This creates a vibration or excitation energy within the plasma elevating the temperature in the tube in advance of pulsing being initiated. Upon reaching, or sufficiently close to, a steady state operating temperature, the arc tube 30 is then switched to a pulsing mode wherein current is provided in staggered on and off modes. See FIG. 2. By preheating the arc tube to a sufficient temperature, the amount of power required to sustain illumination is reduced, thereby the life of the bulb is significantly extended for pulsing operation.

As discussed previously, when an arc tube is sparked from a cold temperature to produce light immediately, large amounts of power are needed to vaporize and excite the fill of salts and Xenon gas contained in the bulb. This vaporization of salts and excitation of gasses in the bulb requires large amounts of energy. The energy needed to sustain illumination in the bulb is greatly reduced when the vibrational energy stored in the plasma, and dependent on temperature, is high. When pulsing mode is engaged, and the ambient temperature of the plasma contained in the arc tube is already sufficiently high, dramatically less power is required to sustain illumination in the tube than when the ambient temperature of the bulb is cold. This reduced power level increases the longevity of the bulb by reducing the power needed to sustain the plasma discharge between the electrodes and, consequently, heat the gasses contained within the tube.

There are several advantages to preheating the fill contained in the bulb prior to initiating pulsing mode. It reduces the power draw during pulsing operation. This is done by requiring less power to maintain illumination when the tube is hot as opposed to the power required when the arc tube is cold. Furthermore, preheating the fill in arc tube prior to pulsing allows more energy to be spent on emitting light rather than on re-vaporizing the fill to reestablish the plasma state within the tube.

The current manipulator 20 may be electronically adjustable such that it is integrated with circuitry to determine either a set passage of time has elapsed or to sense a desired power level to the arc tube, and upon reaching that preset condition, the manipulator is capable of changing the current from a constant flow to a pulsing flow. Or, in the alternative, the current manipulator 20 can be manually adjustable such that the user may flip a switch or perform some other manual function which will change the current flow from a constant current to a pulsing current.

Where the current manipulator is electronically adjustable, and change in current flow is dependent upon a preset time, the present invention teaches up to a thirty second delay as being sufficient to allow the arc tube gasses to reach a sufficiently close to steady state operating temperature. However, when operating under extreme conditions, power monitoring circuitry can be utilized to monitor power levels to the bulb for a suitable period of time or to reach a suitable temperature before entering into the pulsing mode or the time delay can be extended. The time or power level controlled delay can be suitably adjusted up or down to meet the performance needs of differing applications.

A method as taught by the present invention includes providing the hardware described in the apparatus, including a power source 10, a current manipulator 20, a ballast 40 and an arc tube 30, and providing to the arc tube a desired power level for a selected period of time or until the arc tube reaches a given power level and associated operating temperature, and then switching the current to a pulsing current wherein in one embodiment the arc tube goes from an on mode to an off mode at a selected rate of approximately one-half Hertz to approximately two Hertz. The applicable, selected rate may vary dramatically depending on the circumstances. The methods will produce the same beneficial results as taught in the apparatus, including extending the life of the arc tube, reducing the power draw during pulsing operation, and increasing the brightness of the bulb to substantially maximum brightness upon pulsing initiation.

What is claimed:

1. An HID lamp apparatus comprising:

a power source;

a current manipulator coupled to the power source; and a ballast coupled to the current manipulator and coupled to an arc tube wherein the current manipulator initially delivers constant current flow to the ballast until the arc tube reaches a temperature sufficiently close to a steady state operating temperature before changing to a pulse mode wherein the pulse mode pulses a current flow between ½ Hertz to 2 Hertz cycles.

2. The apparatus of claim 1 wherein the current manipulator is manually adjustable.

3. The apparatus of claim 1 wherein the change of the current manipulator from constant mode to pulse mode is bulb power dependent.

4. The apparatus of claim 1 wherein the current manipulator further comprises a timing mechanism and means for manipulating current.

5. The apparatus of claim 1 wherein the change of the current manipulator from constant mode to pulse mode is time dependent.

6. The apparatus of claim 1 wherein the arc tube is a high intensity discharge burner.

7. The apparatus of claim 1 wherein the arc tube begins pulse mode at substantially full strength illumination.

8. The apparatus of claim 1 wherein the power draw during pulsing operation is reduced.

9. The apparatus of claim 1 wherein the time duration of the constant current flow to the ballast is between twenty and thirty seconds.

10. The apparatus of claim 1 wherein the current manipulator is electronically adjustable.

11. The apparatus of claim 10 wherein the current manipulator is electronically adjustable during warm up phase.

12. The apparatus of claim 10 wherein the current manipulator electronically adjusts pulsing rate during pulsing mode.

* * * * *